United States Patent [19]

Tanaka et al.

[11] 4,335,292

[45] Jun. 15, 1982

[54] HIGH FREQUENCY OVEN WITH DRAWER TYPE DOOR

[75] Inventors: Junzo Tanaka, Fujiidera; Chikao Nakano; Hitoshi Kurita, both of Yamatokoriyama, all of Japan

[73] Assignee: Matsushita Electric Industrial Co., Ltd., Kadoma, Japan

[21] Appl. No.: 137,444

[22] Filed: Apr. 4, 1980

[30] Foreign Application Priority Data

May 9, 1979 [JP] Japan ..... 54-57329
May 9, 1979 [JP] Japan ..... 54-62072[U]

[51] Int. Cl.[3] ..... H05B 6/78

[52] U.S. Cl. ..... 219/10.55 F; 219/10.55 D; 219/10.55 R; 126/340; 211/193; 312/236

[58] Field of Search ..... 219/10.55 F, 10.55 R, 219/10.55 D, 10.55 C, 10.55 E, 392, 391; 126/340, 339, 190, 19 M; 99/399; 312/236, 335, 339, 340; 211/193

[56] References Cited

U.S. PATENT DOCUMENTS

| | | | |
|---|---|---|---|
| 733,037 | 7/1903 | Heimann | 211/193 X |
| 2,133,639 | 10/1938 | Smith et al. | 126/340 |
| 2,671,699 | 3/1954 | Vignos | 312/339 X |
| 2,782,292 | 2/1957 | Long | 126/340 X |
| 3,212,836 | 10/1965 | Johnson | 211/193 X |
| 3,440,385 | 4/1969 | Smith | 219/10.55 R |
| 3,854,021 | 12/1974 | Moore et al. | 219/10.55 E |
| 4,080,524 | 3/1978 | Greenfield, Jr. et al. | 219/10.55 E |
| 4,131,778 | 12/1978 | Tanaka et al. | 219/10.55 F |
| 4,254,450 | 3/1981 | White et al. | 219/10.55 R X |

*Primary Examiner*—Bruce A. Reynolds
*Assistant Examiner*—Philip H. Leung
*Attorney, Agent, or Firm*—Wenderoth, Lind & Ponack

[57] ABSTRACT

An improved high frequency heating apparatus of a type having a drawer-type door assembly together with a turn-table driven from the exterior of a heating chamber and also a support shelf therefor, which is so arranged that the stroke of the door assembly for closing and opening may be set irrespective of depth of the heating chamber, with the positional relation between the turn-table and bottom wall of the heating chamber being accurately maintained during driving of the turn-table.

9 Claims, 25 Drawing Figures

HIGH FREQUENCY OVEN WITH DRAWER TYPE DOOR

BACKGROUND OF THE INVENTION

The present invention generally relates to a high frequency heating apparatus, and more particularly to a high frequency heating apparatus for cooking or a microwave oven of a type which includes an oven defining structure having an access opening leading into a heating chamber in the oven defining structure, a drawer type door assembly for selectively closing and opening the access opening, a support shelf member fixed to the door assembly in a cantilever state, and a turn-table mounted on the support shelf member and operated by magnetic coupling through remote driving from the outside of the heating chamber during the heating of an object to be heated or cooked.

Generally, in a high frequency heating apparatus which is arranged to heat objects such as food material, the heating is based on the principle of dielectric heating. The object is cooked by the generation of heat at the interior of said object which is different from the heating by electric heaters or the like wherein the object is heated from the exterior thereof, and therefore, in the presence of uneven heating, there has been a possibility that the interior of the object to be heated is cooked excessively, while the exterior thereof appears not done, thus resulting in a failure of the electric heaters or the like to cook effectively.

For preventing uneven heating as described above, various conventional arrangements have been proposed in which the rotation of the object to be heated, which is mounted on a turn-table during cooking is often employed as one method of achieving stable heating. In the above cases, an arrangement in which a turn-table is driven by a magnetic coupling through remote control from outside of the heating chamber is considered to be extremely convenient for practical use from the viewpoint of cleaning, etc. the interior of the heating chamber. Additionally, when the heating apparatus is used while in a low position, for example, in a state where it is directly placed on a floor or the like, it is recommended for convenience of operation to employ a heating apparatus of a type in which the door assembly is arranged to reciprocate in the direction of the depth of the apparatus for the selective closing and opening of an access opening, and the support shelf for the turn-table is mounted at its one edge to the door assembly and is inserted into or withdrawn from the heating chamber following a closing or opening of said door assembly.

Incidentally, for meeting the requirements of construction as described above in which the turn-table is driven through an external remote driving with the turn-table and the support shelf therefor being arranged to be inserted or withdrawn into the heating chamber respectively as the door assembly is moved for closing and opening, there are serious problems which are related to a stable holding of the support shelf in position. More specifically, when the support shelf is intended to be held in position only at its one edge by the door assembly alone, the height and inclination of the turn-table may be undesirably altered due to a bending or warping thereof upon the placing of an item to be heated on the turn-table, thus resulting in a hindrance of the smooth remote driving of the turn-table through the magnetic coupling. While on the contrary, if it is so arranged that the support shelf is supported at its opposite edges, with the one edge thereof being held by the door assembly and rollers or the like provided at its other edge and being adapted to contact the bottom wall of the heating chamber at all times, the depth or length of the support shelf is required to be larger than a stroke or distance necessary for the movement of the door assembly for the closing and opening thereof, thus the depth of the heating chamber is undesirably increased. However, when it is attempted to take out the object to be heated or a receptacle therefor from the heating chamber having a door assembly of drawer type, it is rather difficult unless the object to be heated or the receptacle is considerably smaller than the stroke for opening and closing the door assembly. Therefore, it is inconvenient that the depth of the heating chamber is longer than the stroke for opening or closing the door assembly.

Accordingly, in a high frequency heating apparatus having a turn-table, driven through remote control from the exterior of the heating chamber, and the support shelf therefor which are arranged to be inserted or withdrawn with respect to the heating chamber following movement of the door assembly in the direction of depth of the heating chamber for closing and opening, it is considered very significant to arrange the apparatus so that the stroke for opening and closing the door assembly thereof may be set as desired irrespective of the depth of the heating chamber, and that during driving of the turn-table thereof, the positional relation between the turn-table and the bottom surface of the heating chamber is correctly maintained.

SUMMARY OF THE INVENTION

Accordingly, an essential object of the present invention is to provide an improved high frequency heating apparatus of a type having a drawer-type door assembly, a turn-table driven through remote control from the exterior of a heating chamber, and a support shelf therefor which are arranged so that the stroke of the door assembly for closing and opening is irrespective of the depth of the heating chamber, and the positional relation between the turn-table and bottom wall of the heating chamber is precisely maintained during driving of the turn-table.

Another important object of the present invention is to provide an improved high frequency heating apparatus of the above described type which is substantially free from uneven heating during high frequency heating and from a potential spark discharge by the support shelf for the turn-table in the heating chamber, and wherein the support shelf is arranged to be held at a predetermined position with respect to the door assembly.

A further object of the present invention is to provide an improved high frequency heating apparatus of the above described type in which a leakage of microwave energy from the peripheral portion of the door assembly is substantially prevented at all times during operation of the heating apparatus, even when external forces are applied to the door assembly.

A still further object of the present invention is to provide an improved high frequency heating apparatus of the above described type in which side play of the door assembly is reduced to a large extent, while the movement of said door assembly for opening and closing the heating chamber is arranged to be as smooth as possible.

Another object of the present invention is to provide an improved high frequency heating apparatus of the above described type which is simple in construction, reliable in function, and is easy to assemble for production on a large scale at low cost.

In accomplishing these and other objects according to one preferred embodiment of the present invention, there is provided a high frequency heating apparatus which includes an oven defining structure having an access opening leading into a heating chamber defined therein, a high frequency energy oscillating means for supplying the high frequency energy into the heating chamber, a drawer type door assembly of substantially L-shaped configuration arranged to be moved in a direction substantially parallel to the direction of depth of the heating chamber so as to the inserted into and withdrawn from the oven defining structure for selective closing and opening of the access opening, a shelf member mounted at its one edge to the door assembly in a cantilever fashion, a turn-table mounted on the shelf member and arranged to be driven for rotation by remote control from outside of the heating chamber through a magnetic coupling means during heating of an object to be heated, and driving means provided in the vicinity of a bottom wall of the heating chamber for rotating said turn-table by the magnetic coupling means. The shelf member is supported at one edge thereof, by door assembly in a cantilever fashion upon withdrawal of the door assembly from the oven defining structure for the of the access opening, and, upon insertion of the door assembly into the oven defining structure for closing the access opening, at the opposite edges thereof with the one edge being supported by the door assembly and the other edge being supported by the bottom wall of the heating chamber with the shelf member being located adjacent to the bottom wall of the heating chamber.

By this arrangement according to the embodiment of the present invention as described above, there is presented an improved high frequency heating apparatus in which the stroke of the door assembly can be determined regardless of the depth of the heating chamber, and the positional relation between the turn-table and bottom wall of the heating chamber is accurately maintained during the driving of the turn-table with substantial elimination of disadvantages inherent in conventional arrangements.

BRIEF DESCRIPTION OF THE DRAWINGS

These and other objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
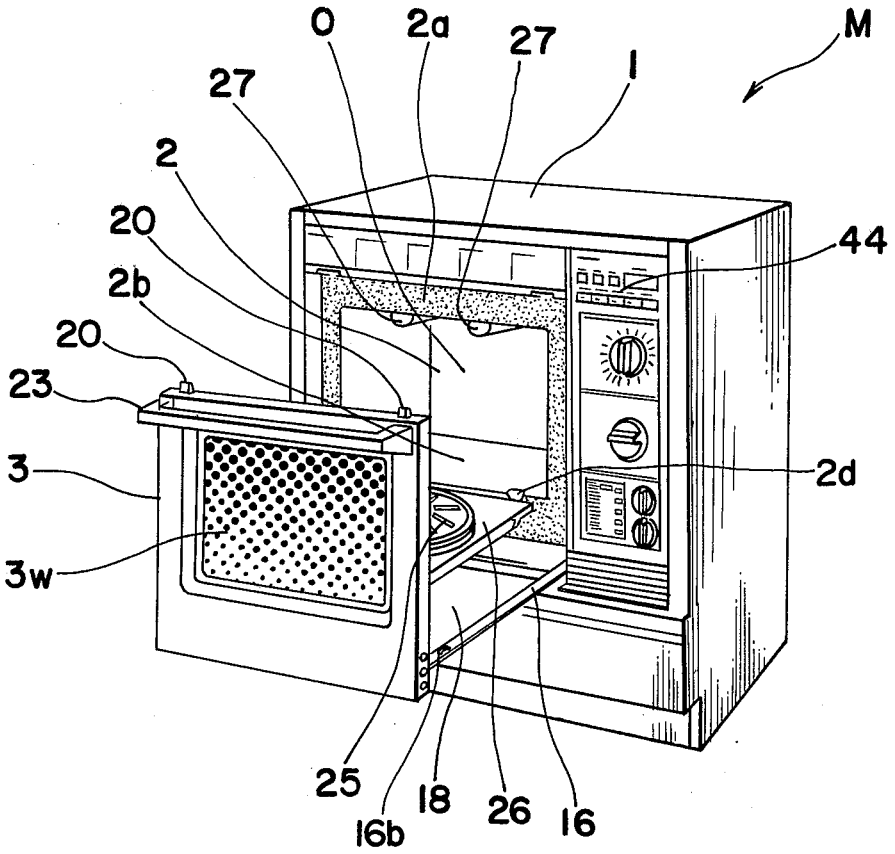
FIG. 1 is a perspective view showing a high frequency heating apparatus in the form of a microwave oven according to one preferred embodiment of the present invention, with the door assembly thereof in the opened state.
Figure 2:
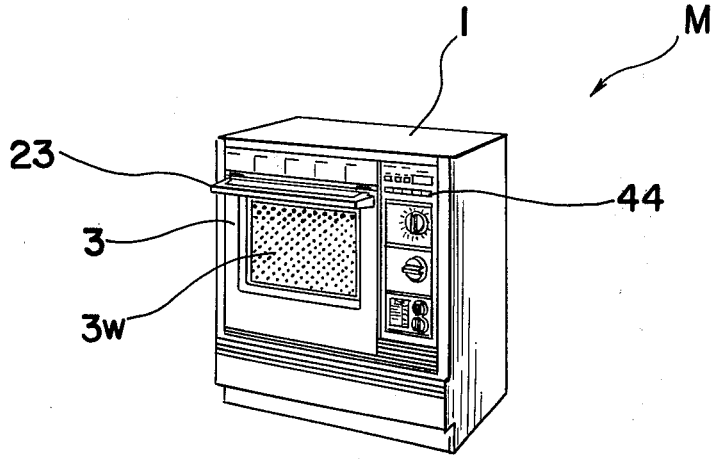
FIG. 2 is a view similar to FIG. 1 which shows in a reduced scale the microwave oven, with the door assembly thereof in the closed state.
Figure 3:
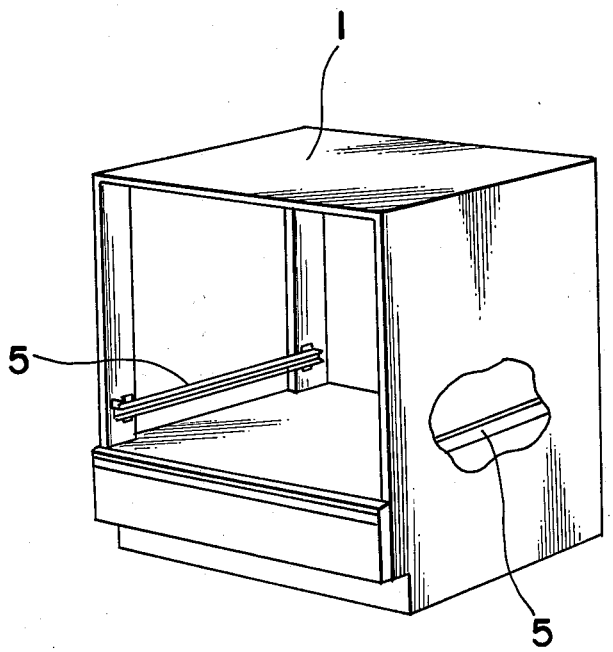
FIG. 3 is a perspective view of an outer casing employed in the microwave oven of FIG. 1.
Figure 4:
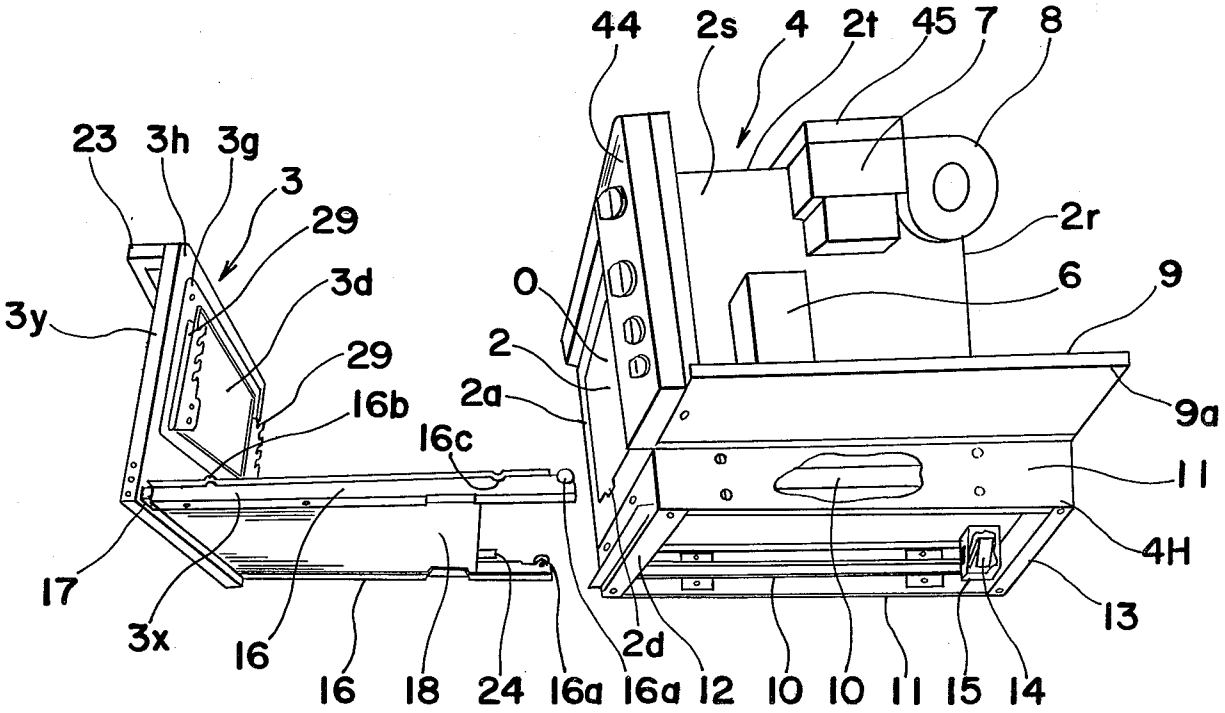
FIG. 4 is a perspective view of an inner main structure defining a heating chamber with the outer casing shown in FIG. 3 removed and with the door assembly drawn out therefrom for clarity.

Referring now to the drawings, there is shown in FIGS. 1 to 4 a high frequency heating apparatus or microwave oven M to which the present invention may be applied. The microwave oven M heat-treats objects or food material based on the principle of dielectric heating by utilizing high frequency energy, for example, on the order of about 2,450 MHz, and generally includes an outer casing 1 of a cubic box-like configuration (FIG. 3) open at the front side thereof, an inner main structure 4 (FIG. 4), defining a heating cavity or heating chamber 2 and forming a double wall construction together with the outer casing 1, and a generally L-shaped door assembly 3 (FIG. 4), of drawer type which is arranged to be slidable in the direction of the depth of said heating chamber 2 for selectively opening and closing an access opening O of the heating chamber 2 as shown in FIGS. 1 and 2.

The inner main structure 4 is arranged to be detachable from the outer casing 1 through a pair of rail members 5 (FIG. 3), each having a generally U-shaped cross section and respectively secured to opposite side walls of the casing 1 in a manner as described hereinbelow.

Figure 5:
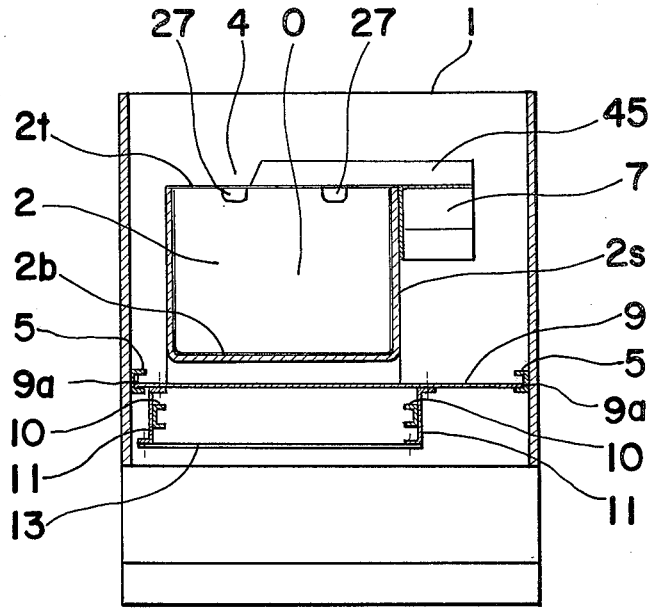
FIG. 5 is a schematic front sectional view of the microwave oven of FIG. 1.
Figure 6:
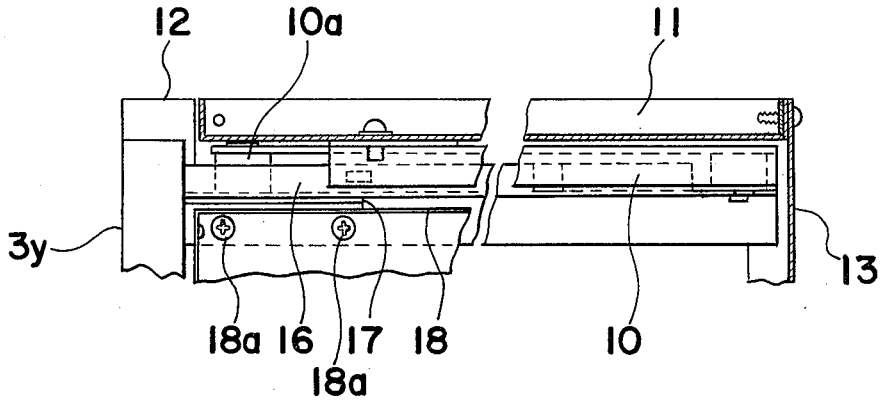
FIG. 6 is a fragmentary partially sectional top plan view, showing on an enlarged scale the sliding portion of the door assembly of the microwave oven of FIG. 1.

More specifically, the inner wall structure 4 includes a base plate 9, for example a metallic plate material, which supports the weight of the heating chamber 2, defined by a top wall 2*t*, side walls 2*s*, a rear wall 2*r*, and a front wall 2*a*, a bottom wall 2*b*, which has an access opening O formed therein, which is secured to the base plate 9 by screws or the like, a high tension transformer 6, and a high frequency energy source, for example a magnetron 7 capable of emitting microwaves upon energization, a waveguide 45 coupling the magnetron 7 with the heating chamber 2 in a known manner, a cooling fan 8 for cooling the magnetron 7, a control panel 44 provided at the right front portion of the structure 4 as shown in FIGS. 1 and 2 and carrying thereon suitable knobs, indicator lamps, etc. for controlling the functioning of the magnetron 7 and an electric heating arrangement such as heaters 27 or the like provided at the upper portion of the heating chamber 2. In the lower edge of wall 22 defining the access opening O there is formed a recess or dint 2*d* for enabling a turn-table support shelf 26 (discussed later) to be smoothly inserted into the oven M. On the under surface of the base plate 9 there is provided an under structure 4H (FIG. 4) defined for example, by opposite side plates 11, front and rear reinforcing plates 12 and 13, a pair of rail members 10 of generally U-shaped cross section secured to the side plates 11, and a housing 15 provided at one corner of the under structure 4H for accommodating therein a switch member 14 to be discussed later. When the outer casing 1 is combined with the inner main structure 4, the base plate 9 is engaged at its opposite edges 9*a* with the rail members 5 of the outer casing 1 as shown in FIG. 5.

Referring also to FIGS. 6 to 10, a door assembly 3 having a vertical front portion 3Y with a handle 23 and a horizontal portion 3X which laterally extends from the lower part of the portion 3Y and includes a pair of rail members 16 each having a generally Z-shaped cross section and are respectively secured at one end thereof to said portion 3Y by corresponding L-shaped metal pieces 17 in a manner discussed later. A support plate 18 is held between the rail members 16 for reinforcement thereof, and the L-shaped metal pieces 17 and rail members 16 are fixed together with the support plate 18 by set screws 18*a*. At the other end of each of the rail members 16 a corresponding pair of rollers 16*a*, for example, ball bearings, are rotatably mounted, and another pair of similar rollers 10*a* are rotatably supported by the stationary rail members 10 in positions adjacent to the lower part of the vertical portion 3Y of the door assembly 3. For the smooth sliding movement of the movable rail members 16 of the door assembly 3 with respect to the stationary rail members 10 of the inner main structure 4, the rollers 10*a* contact the rail members 16 at the peripheries thereof and roll on said movable rail members 16, while the rollers 16*a* of the movable rail members 16 contact the stationary rail members 10 at the peripheries thereof and roll on said rail members 10.

The side play of the door assembly 3 in the lateral direction with respect to the inner main structure 4 may be regulated by loosening the set screws 18*a*, for the rail members 16 and support plate 18, and adjusting the distance l (FIG. 10) between the rail members 16, which are secured to each other through the plate 18, so that side faces of the rollers 10*a* contact the movable rail members 16 and side faces of the rollers 16*a* contact the stationary rail members 10. In the above case, if side play of the door assembly 3 in the vertical direction, i.e. vertical side play between the movable rail members 16 and stationary rail members 10, has been completely eliminated, no allowance is provided in the event of any slight curving or bending of the rail members 10 and 16, etc., and thus, it becomes impossible to achieve a smooth sliding movement between the movable rail members 16 and stationary rail members 10 even if only a very slight dimensional variations or deformation is present.

Figure 7:
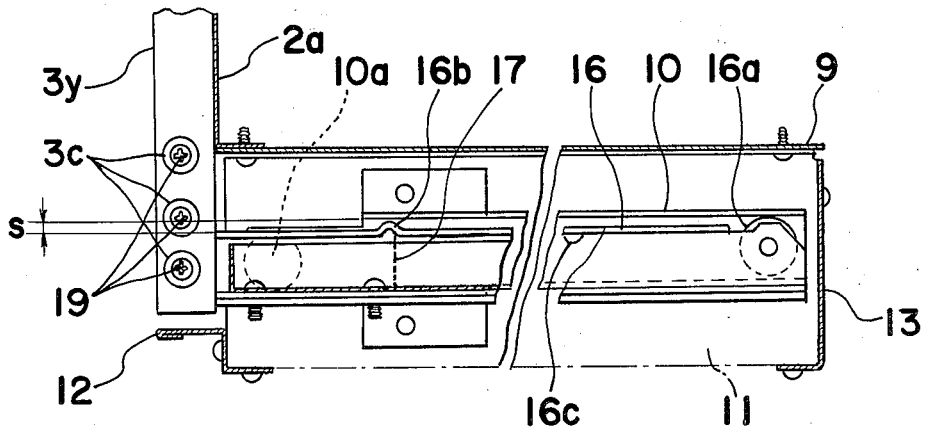
FIG. 7 is a fragmentary sectional side elevational view, showing on an enlarged scale the sliding portion of the door assembly of the microwave oven of FIG. 1.
Figure 8:
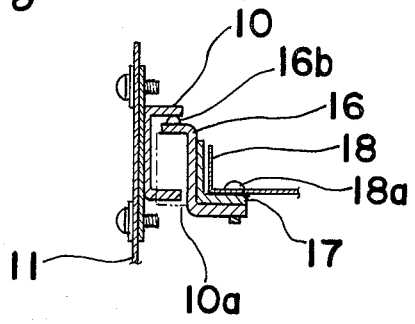
FIG. 8 is a fragmentary cross sectional view of the arrangement of FIG. 6.

In order to overcome this inconvenience as described immediately above, according to the present invention, there is provided a side play prevention projection 16*b* extending upwardly from one portion of the upper surface of the folded upper edge of each of the movable rail members 16 adjacent to the lower part of the vertical portion 3Y of said door assembly 3. The projections 16*b* engage the stationary rail members 10 upon closing of the door assembly 3 so as to render the vertical side play of the door assembly 3 substantially zero, whereby an undesirable leakage of microwaves through peripheral portions of the door assembly 3 due to a positional deviation thereof may be advantageously eliminated. In the state where the door assembly 3 is withdrawn or opened, an allowance or clearance S for the vertical side play for smooth movement of the door assembly 3 is provided as shown in FIG. 7.

Figure 9:
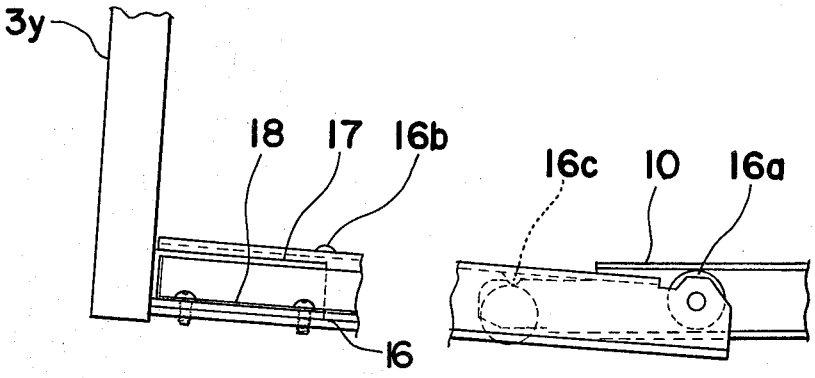
FIG. 9 is a schematic diagram illustrating the attaching and detaching of the door assembly with respect to the inner main structure of FIG. 4.

As illustrated in FIG. 9, other projections or stoppers 16*c* extend downwardly from the under surface of each of the folded upper edges of the movable rail members 16 in a direction opposite to that of the projections 16*b* and are located in positions remote from said projections 16*b*. For detaching or attaching the door assembly 3, it is necessary for the rollers 10*a* to ride over the stoppers 16*c*, with the movable rail members 16 of the door assembly 3 being inclined to some extent with respect to the stationary rail members 10. In the above case, since the allowance S for the side play is provided as the door assembly 3 is moved, the detaching or attaching of the door assembly 3 is facilitated.

Figure 10:
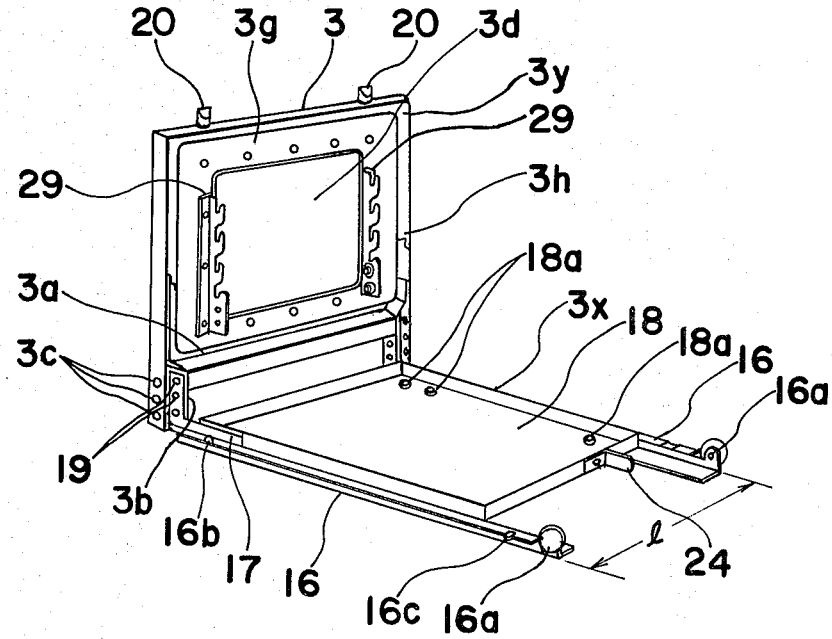
FIG. 10 is a perspective view of the door assembly employed in the microwave oven of FIG. 1, with the vertical portion thereof being disengaged from the horizontal portion for clarity.
Figure 11:
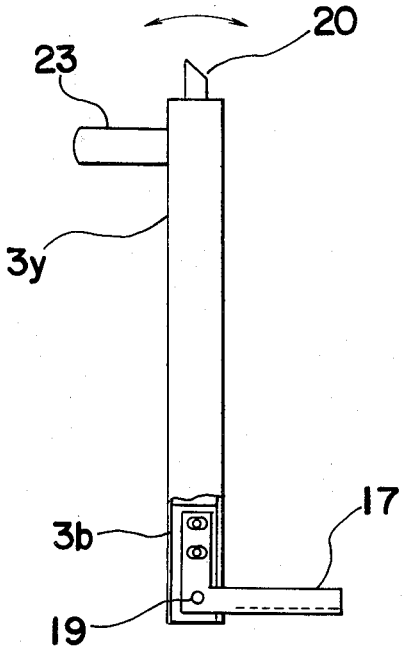
FIG. 11 is a schematic side elevational partially sectional view on an enlarged scale of the door assembly illustrating the state of connection between the vertical and horizontal portions thereof.
Figure 12:
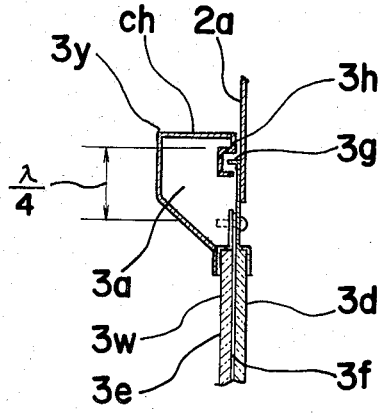
FIG. 12 is a cross section of the vertical portion of the door assembly showing the detailed construction thereof.

Referring particularly to FIGS. 10 and 12 showing the connection between the vertical portion 3Y of the door assembly 3 and L-shaped metal pieces 17 discussed earlier, the vertical portion 3Y of the door assembly 3 includes a choke structure ch having a groove or hollow portion 3*a* of λ/4 wavelength (where λ is the inner tube wavelength of high frequency waves) and surrounding the peripheral edge portions of the portion 3Y for preventing microwave leakage. The L-shaped metal pieces 17 are fixed to the lower sides of the vertical portion 3Y of the door assembly 3 at fixing portions 3*b*, which are located outside the choke structure ch, for example by three set screws 19 extending through portions 3*b* and corresponding openings formed in the metal pieces 17. Since the upper two openings for the set screws 19 for each of the metal pieces 17 are elongated, the vertical portion 3Y of the door assembly 3 is adjustable to a certain extent through its pivoting about the lowest screw 19 as shown in FIG. 11 with respect to the horizontal portion 3X and to the heating chamber 2. Thus the vertical portion 3Y of the door assembly 3 can be favorably brought into close contact with peripheral portion 2*a* which defines the access opening O of the heating chamber 2. Furthermore, since the set screws 19 screwed into corresponding openings 3*c* formed at the lower sides of the vertical portion 3Y are releasable from outside, the mounting of the L-shaped metal pieces 17 to the vertical portion 3Y and the adjustment of the inclination of the portion 3Y with respect to the portion 2*a* of the heating chamber 2 may be effected after the assembling of the door assembly 3. Moreover, by providing the fixing portions 3*b* at the outside of the choke groove 3*a*, i.e. at the lower opposite sides of the door assembly 3, a better choke effect can be achieved.

Still referring to FIG. 12, the vertical portion 3Y of the door assembly 3 has an observation window 3*w* of a known construction including a pair of transparent plates 3*d* and 3*e*, for example of reinforced glass, and a punched metal 3*f* held therebetween. The peripheral portion of the observation window 3*w* is surrounded by a metallic contact plate 3*g* for contact with the corresponding peripheral portion 2*a* of the heating chamber 2, with a cover member 3*h* of microwave transmitting material such as synthetic resins being provided between the peripheral portions of the contact plate 3*g* and vertical portion 3Y. The glass plates 3*d* and 3*e*, the punched metal 3*f*, and the contact plate 3*g*, etc. as described above are secured to the vertical portion 3*y*, for example, by suitable set screws.

Figure 13:
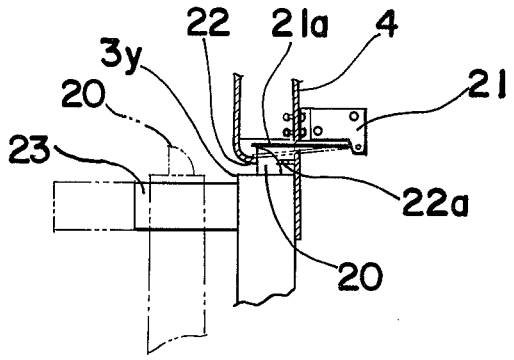
FIG. 13 is a fragmentary cross sectional view illustrating the arrangement of a switch member provided at the upper portion of the inner main structure and associated in its function with the door assembly.
Figure 14:
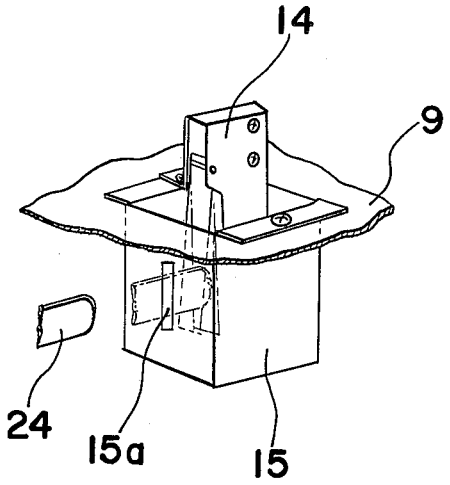
FIG. 14 is a fragmentary perspective view illustrating another switch member provided at the lower portion of the inner main structure and associated in its function with the door assembly.

Referring to FIGS. 13 and 14 which show switch members for actuating a high frequency generation circuit, at the upper portion of the inner main structure 4, there is disposed a first switch 21 having normally open contacts so as to correspond to keys 20 (FIGS. 10 and 11) which are slidably provided at the upper edge of the vertical portion 3Y and normally urged upwardly by suitable spring means (not shown). When the door assembly 3 is closed, the keys 20 contact an inclined portion of an engaging wall 22 provided at the upper part of the inner main structure 4 and are depressed so as to engage corresponding openings 22*a* formed in the engaging wall 22, and in the above case, the keys 20 are restored to their upward most position so as to push up a lever 21*a* of the switch 21 to close said switch 21. Subsequently, when the handle 23 provided at the upper front portion of the door assembly 3 is pulled for opening, the keys 20 are again depressed by the engaging wall 22 so as to be disengaged from the openings 22*a*, and thus, the door assembly 3 is withdrawn, with the switch 21 opened. Upon opening of the door assembly 3, the keys 20 are restored to their upward most position. At the edge of the support plate 18, remote from the vertical portion 3Y of the door assembly 3, a shank or pin 24 (FIGS. 10 and 14) is suitably secured, for example by a screw, in a position corresponding to the housing 15 (FIGS. 4 and 14) for the second switch 14 having normally open contacts as previously mentioned. The housing 15 has a slit 15*a* formed at its front face for allowing the pin or shank 24 to extend therethrough as the door assembly 3 is closed, so that the normally open second switch 14 in the housing 15 is closed by the pin 24.

Figure 15:
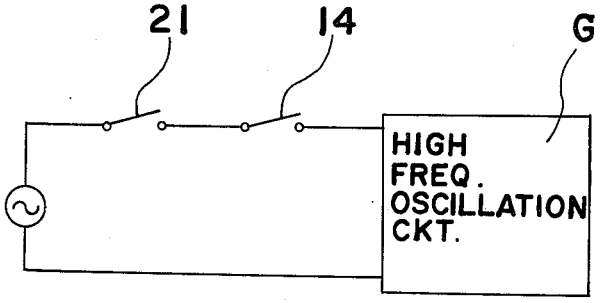
FIG. 15 is an electrical circuit diagram showing the arrangement of the switch members of FIGS. 13 and 14, FIGS. 16(A) and 16(B) are fragmentary side elevational views illustrating the state of the door assembly during a closing thereof.
Figure 16:
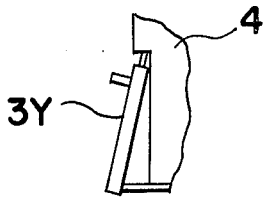
Figure 16:
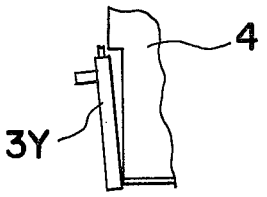

As is seen from FIG. 15 showing a schematic electrical diagram of the circuit for effecting the high frequency heating, the first switch 21 and second switch 14 are connected in series with respect to the high frequency oscillation circuit G and power source. Therefore, the circuit G is not brought into operation unless both of the first and second switches 21 and 14 are closed. In connection with the above, since the vertical portion 3Y of the door assembly 3 is adjustable for the inclination with respct to the horizontal portion 3X and, the fixing portions 3*b* are particularly provided at the ouside of the choke groove 3*a*. The strength of coupling the vertical portion 3Y and L-shaped metal pieces 17 is rather limited, and upon exertion of external force on the door assembly 3, deviations tend to take place in the direction of the inclination adjustment. However, according to the arrangement of the present invention, when the vertical portion 3Y is deviated to incline inwardly with respect to the heating chamber 2 as shown in FIG. 16(A), the second switch 14 is not closed, and upon inclination of the portion 3Y outwardly as shown in FIG. 16(B), the first switch 21 is not actuated. Therefore, the high frequency oscillation circuit G is not operated in either of the above cases, and consequently, the dangers such as abnormal leakage of microwave energy through peripheral portions of the door assembly 3 may be prevented. When the door assembly 3 is arranged to be detachable, there is a possibility of accidentally dropping the assembly 3. According to the arrangement of the present invention, however, should the door assembly 3 be accidentally dropped during handling, some deformation takes place in the pin 24. When this deformation exceeds a predetermined amount, the pin 24, restricted in function by the slit 15*a*, can not go fully into the housing 15 even when the door assembly 3 is closed, and therefore, the second switch 14 is not closed for securing safety.

Figure 21:
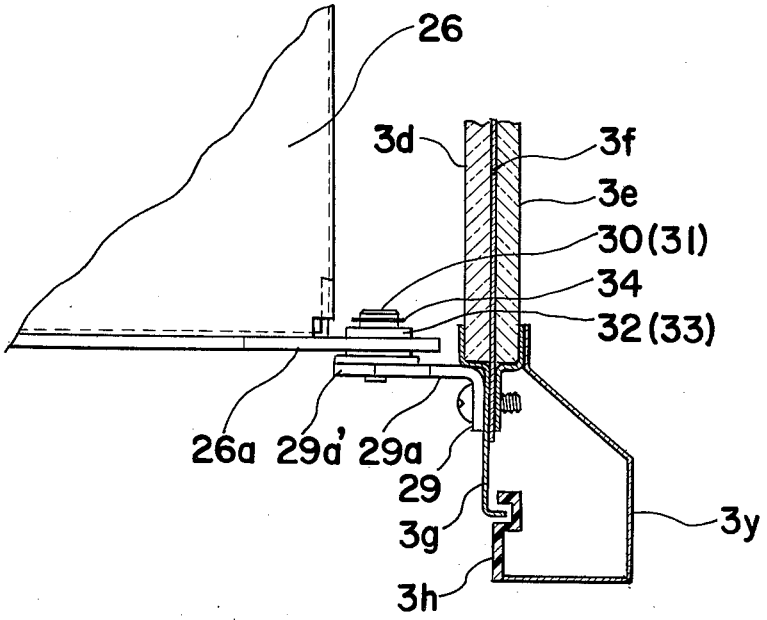
FIG. 21 is a fragmentary top plan view, on an enlarged scale, of the turn-table support shelf showing the engagement thereof with the door assembly.
Figure 22:
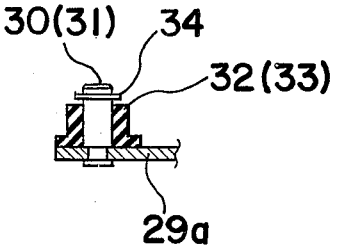
FIG. 22 is a fragmentary side sectional view showing the arrangement of metallic pins employed for the engagement of the turn-table support shelf with the door assembly.
Figure 23:
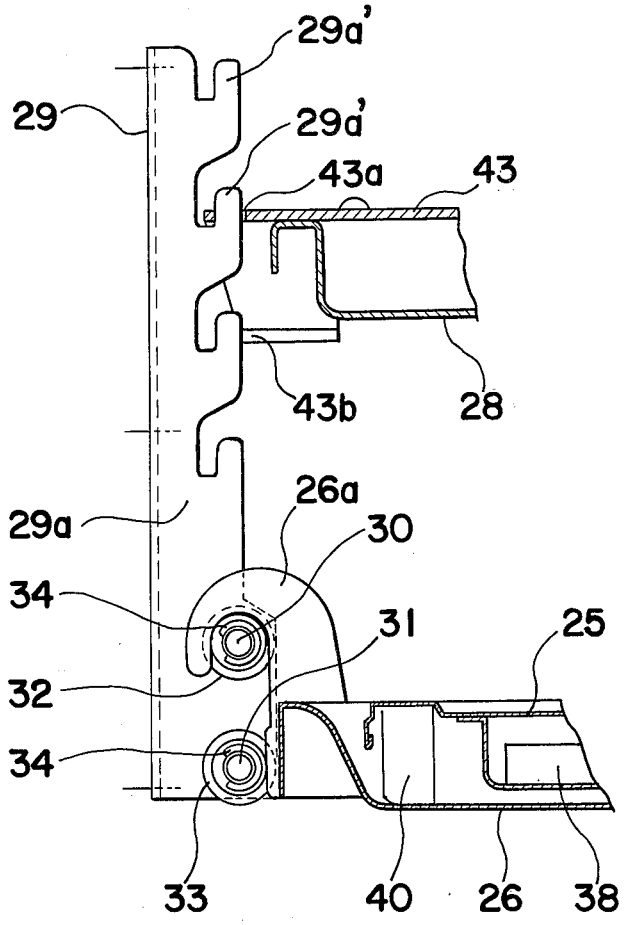
FIG. 23 is a fragmentary side elevational view showing, on an enlarged scale, the structure of metal plates with hook members attached to the door assembly.
Figure 24:
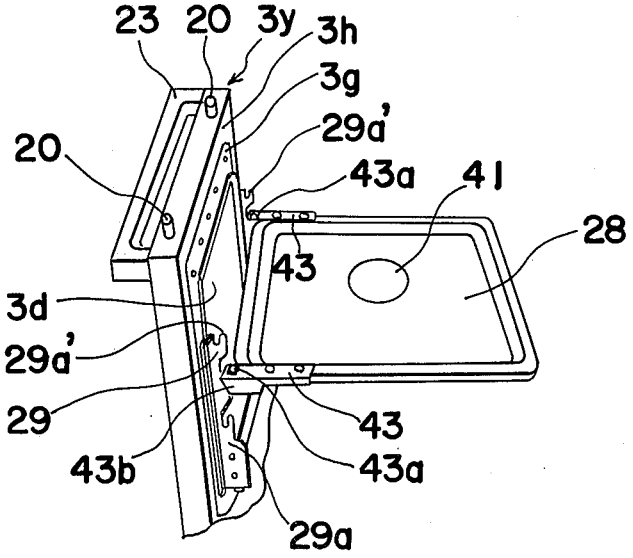
FIG. 24 is a perspective view of the door assembly with the oven plate attached thereto.

Reference is made to FIGS. 17 to 24 showing the relation between the door assembly 3, and a turn-table shelf 26, for a turn-table 25 to prevent uneven heating, which is supported at its one edge by the vertical portion 3Y of the door assembly 3 so as to be selectively inserted into or withdrawn from the heating chamber 2 together with the door assembly 3X. An object 41 to be heated is set on the turn-table 25. The relation between the door assembly 3 and an oven plate 28 to be used for placing the object 41 to be heated thereon so as to alter the state of heating, etc. in the case of heating by a separate heat source or electric heaters 27 is shown in FIGS. 23 and 24.

Figure 17:
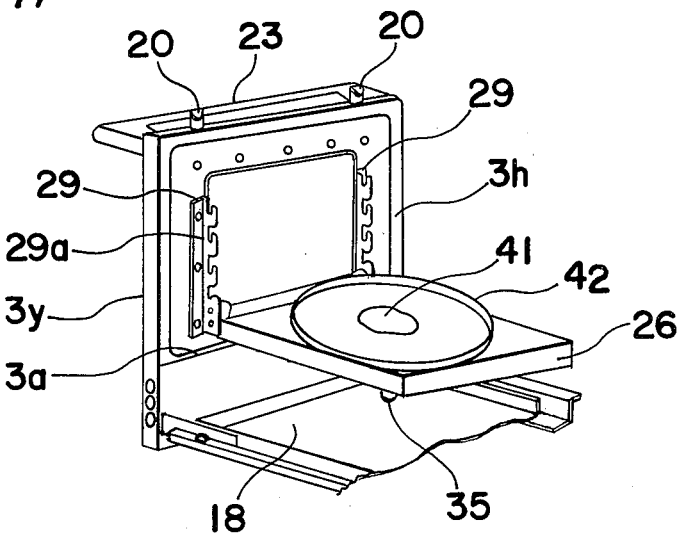
FIG. 17 is a partial perspective view of the door assembly with a support shelf for a turn-table attached thereto.
Figure 18:
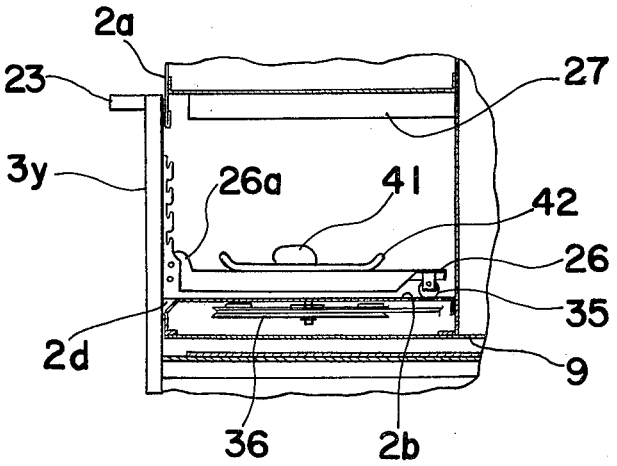
FIG. 18 is a schematic side sectional view of the microwave oven of FIG. 1 illustrating a driving mechanism for the turn-table.
Figure 19:
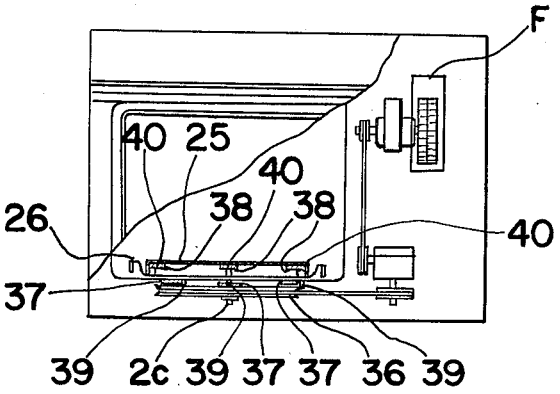
FIG. 19 is a schematic front elevational view, partly broken away, of the microwave oven of FIG. 1 with the door assembly removed illustrating the driving mechanism for the turn-table.
Figure 20:
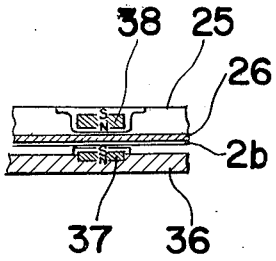
FIG. 20 is a fragmentary sectional view of one portion of the driving mechanism of FIGS. 19 and 20 particularly showing the arrangement of magnets therefor.

The turn-table shelf 26 is made of metallic material with permeability such as SUS 304. On the contact plate 3*g*, the vertical portion 3Y of the door assembly 3 which contacts the periphery of portion 2*a*, a pair of metallic plates 29 of L-shaped cross section are secured by the screws connecting the contact plate 3*g* with the vertical portion 3Y. A plurality of hooks 29*a*′ are formed in the projecting wall 29*a* of each hook plate 29 and extend in the direction of the depth of the heating chamber 2 for engagement with the oven plate 28. At predetermined portions of the projecting walls 29*a* of plates 29, corresponding pairs of opposed metallic pins 30 and 31 are fixed, for example by staking, so as to support the turn-table shelf 26. Hollow insulation rings 32 and 33, made of ceramic materials such as alumina ceramics, are releasably applied around the pins 30 and 31 so as to be retained by suitable retainer rings 34 (FIGS. 21 and 22). In the above embodiment, the pins 30 and 31 and insulation rings 32 and 33 can be formed as integral parts. At the opposite sides of one edge of the shelf 26, a pair of claw members 26*a* are fixed so as to be releasably engaged with the insulation rings 32 and 33. A pair of rollers 35 (FIGS. 17 and 18), made of an insulating material such as glass fiber, are rotatably provided adjacent to the other edge of the shelf 26, so that in a state where the door assembly 3 is withdrawn as in FIG. 17, the shelf 26 is supported only by the claw members 26*a* thereof as in a cantilever. When the door assembly 3 is inserted or closed, the rollers 35 contact the bottom wall 2*b* of the heating chamber 2 so that the shelf 26 is supported at the opposite edges as shown in FIG. 18. In the above case, the presence of the recess 2*d* formed in the lower edge defining the opening O facilitates a smooth insertion of the support shelf 26. Additionally the turn-table 25 is provided with a plurality of magnets 38 (FIGS. 19 and 20) secured to its under surface in positions corresponding to magnets 37 fixed to a pulley 36, which is rotatably supported on the under surface of the bottom wall 2*b* of the heating chamber 2 through a shaft 2*c*. The turn-table 25, rotatably supported by rollers 40, is rotated on the shelf 26 by the magnetic force acting between the magnets 37 and 38 as the pulley 36, contacting the under surface of the bottom wall 2*b* via rollers 39 thereof, is driven by a motor F through a suitable driving force transmission means. The shelf 26 and turn-table 25 are used during the high frequency heating or heating by the heaters 27 with a receptacle or vessel 42, for example of glass, and an object 41 to be heated being placed thereon.

For smoothly bringing the shelf 26 which is supported at its one edge as previously described, into a state where it is held at its both edges as described with reference to FIGS. 17 and 18 or vice versa respectively following the insertion or withdrawal of the door assembly 3, raised portions (not shown) are provided on the bottom wall 2*b* of the heating chamber 2 in positions adjacent to the access opening 0 and correspond to the rollers 35 of the support shelf 26.

As shown in FIGS. 23 and 24, the oven plate 28, made of metallic plate material, is intended for use, with the object 41 to be heated placed thereon, only during heating by the electric heaters 27 as mentioned earlier. To opposite sides at one edge of the plate 28, there are secured a pair of supporting fixtures 43 of U-shaped cross section and each having a square opening 43*a* formed in its upper surface adjacent to the distal end thereof. The oven plate 28 is supported at the end, that corresponds to the hook members 29*a'*, by the engagement of the hook members 29*a'* with the square opening or aperture 43*a* and one side 43*b* of each of the fixtures 43. Since the hook members 29*a'* are provided in plurality and there are spaced intervals between them, the height of the oven plate 28 can be there mentally altered in several steps. For the heating by the electric heaters 27, either the shelf 26 or the oven plate 28 can be employed.

As is clear from the foregoing description, by the arrangement of the embodiment of present invention in which the shelf 26 is supported at its one edge by the door assembly 3 in the cantilever fashion when the door assembly 3 is opened and it is supported at its opposite edges, with the other edge thereof supported by the bottom wall 2*b* of the heating chamber 2 upon closing of the door assembly 3, the stroke for opening and closing of the door assembly 3 may be designed as desired irrespective of the depth of the heating chamber 2. Moreover during the rotation of the turn-table 25, the distance between the magnets 37 and 38 are accurately maintained, and thus, the turn-table 25 rotates stably without being affected by the weight of the object 41 to be heated, or by the warping thereof with time, etc. Furthermore, by the arrangement in which the under surface of the shelf 26 is spaced from the bottom wall 2*b* of the heating chamber 2 by the rollers 35, the danger of a spark discharge or generation of abnormal heat during the high frequency heating due to extreme proximity between the shelf 26 and bottom wall 2*b* has been advantageously eliminated. Additionally, at the one edge of the shelf 26, the claw members 26*a* are provided to engage the pins 30 and 31 of the metallic plates 29 of the door assembly 3 through the insulating rings 32 and 33, while the other edge of the shelf 26 is electrically insulated from the bottom wall 2*b* of the heating chamber 2 through the rollers 35. This arrangement is very advantageous from the viewpoints of stable heating and prevention of spark generation at the engaging portions.

More specifically, as is well known, in the case of high frequency heating, the ability of an apparatus to stably heat is a function of the size of the heating chamber and the size of the object 41. For example, the microwaves in the heating chamber 2 are varied in wavelength upon the insertion of the object to be heated therein by the relation represented by $\lambda e \ \alpha \ 1/\sqrt{\epsilon}$ (where $\lambda e$ is the effective wavelength and $\epsilon$ is dielectric constant of the object to be heated), thus with consequent variations in the conditions of heating. In the above case, if the size of the heating chamber 2 is small as compared with the size of the object 41 to be heated, the wavelength of the microwaves within the heating chamber 2 vary to an extreme extent by the presence or absence of the object 41 to be heated in the chamber 2 according to the relation as described above, and also large variations occur which are a function of the amount and kind of the object 41 to be heated thus making it very difficult to obtain a uniform and stable heating condition. If the size of the heating chamber 2 is sufficiently larger than the object 41 to be heated, the state of the microwave energy within the heating chamber 2 is affected very little by the variations in the amount and kind of the object 41, and thus a more uniform heating is obtained irrespective of the amount and kind of objects to be heated. Particularly, in the arrangement according to the present invention, the support shelf 26 is arranged to electrically "float" in the heating chamber 2, and the portion below the support shelf 26 constitutes a part of the heating chamber 2 with respect to the microwave energy so as to increase the space in the chamber 2 for a more uniform heating condition as described above. Moreover, the support shelf 26 electrically floating advantageously prevents generation of spark discharges etc. between the heating chamber 2 and metallic plates 29.

Generally, the ceramic materials such as alumina ceramics, etc. are extremely strong in resisting compressive loads but very weak against bending loads, etc. In the arrangement according to the present invention, however, since only a compressive load is applied to the insulation rings 32 and 33 as described earlier, the rings 32 and 33 are free from breakage even if a large load is applied to the support shelf 26, and when the rings 32 and 33 are broken by whatever cause they can be readily replaced by removing the retaining rings 34.

Additionally, since the engaging structures of the engaging portions of the support shelf 26 and oven plate 28 with respect to the door assembly 3 are different from each other, accidental engagement of the support shelf 26 with the portion of the door assembly 3 for the oven plate 28 or vice versa is prevented, and thus, not only problems due to spark discharge, generation of heat, etc. arising therefrom are eliminated, but also inconveniences such as a failure in cooking caused by uneven heating due to faulty rotation of the turn-table 25 resulting from an increase in the distance between the magnets 38 of the turn-table 25 and magnets 37 of the pulley 36 are eliminated. Moreover, the structures of the metallic plates 29, for engagement with the engaging portions of the oven plate 28, and the support shelf 26 are different, wherein the engaging portion for the oven plate 28 is constituted by the hook members 29*a*′ formed in the projecting walls 29*a* of the metallic plates 29 which extend inwardly at right angles from the vertical portion of the door assembly 3 and the engaging portion for the support shelf 26 is constituted by providing the pins 30 and 31 directed at right angles with respect to the projecting walls 29*a* of the metallic plates 29; and therefore, when the support shelf 26 is lowered downwards from above the door assembly 3 for engagement with the pins 30 and 31, the shelf 26 can be readily engaged therewith by simply lowering it without obstruction by the hook members, thus providing a structure which is very convenient. Furthermore, due to the arrangement in which the claw members 26*a* of the support shelf 26 are engaged such that they are positioned inside of the projecting walls 29*a* of the metallic plates 29, the engaging portion between the shelf 26 and plates 29 is readily observed from above the door assembly 3 for still an easier attachment and detachment of the support shelf 26.

Although the present invention has been fully described by way of example with reference to the accompanying drawings, it is to be noted that various changes and modifications are apparent to those skilled in the art. Therefore, unless such changes and modifications depart from the scope of the present invention, they should be construed as included therein.

What is claimed is:

1. A high frequency heating apparatus comprising:

a main body having a heating chamber therein;

said heating chamber having an access opening in one side thereof and a bottom wall;

a high frequency energy oscillating means for supplying high frequency energy into said heating chamber;

a drawer type door having a substantially horizontal and vertical portion defining an L shaped cross section in a vertical plane parallel to a longitudinal axis of said door, said horizontal portion being longitudinally slidably received into said main body for allowing said vertical portion to close said access opening;

a pair of metallic plates, said plates being attached to the side of said vertical portion facing said heating chamber and being spaced from one another;

each of said metallic plates having a projecting wall extending toward said heating chamber;

pin members respectively secured to each said projecting wall and respectively having an electrically insulating material therearound;

a cantilever shelf member having claw members at one end thereof, said claw members being adapted to respectively engage at least one of said pin members of each projecting wall and said shelf member one end being adapted to abut at least one of said pin members to detachably mount said shelf member to said vertical portion in a substantially horizontal position;

said shelf member being slidably received within said heating chamber and an end opposite said one end being supported by said bottom wall when said door is moved toward said opening, said shelf member being supported only at said one end when said door is in its furthermost position away from said opening;

said shelf member being electronically insulated from said main body and said door;

a turntable rotatably mounted on said shelf member;

a magnetic coupling means operatively associated with said turntable for rotating said turntable; and a driving means operatively associated with said magnetic coupling means for driving said coupling means and thereby rotating said turntable.

2. A high frequency heating apparatus as claimed in claim 1, wherein the opposite end of said shelf member has rollers rotatably mounted thereon, said rollers are made of electrically insulating material and contact said bottom wall to thereby support said shelf member when said door is moved toward said opening.

3. A high frequency heating apparatus as claimed in claim 1, wherein said electronic insulating member is made of ceramic material.

4. A high frequency heating apparatus as claimed in claim 1, further comprising a mounting means operatively associated with the side of said vertical portion facing said heating chamber and capable of mounting only an oven plate on said vertical portion.

5. A high frequency heating apparatus comprising:

a main body having a heating chamber therein;

said heating chamber having an access opening in one side thereof and a bottom wall;

a high frequency energy oscillating means for supplying high frequency energy into said heating chamber;

a stationary rail member fixedly positioned within said main body and extending along a longitudinal axis thereof;

a drawer type door having a substantially horizontal and vertical portion defining an L shaped cross section in a vertical plane parallal to a longitudinal axis of said door, said horizontal portion being longitudinally slidably receivable into said main body;

a movable rail member attached to said door and extending along a longitudinal axis thereof, said movable rail being slidably received by said stationary rail in the longitudinal direction for allowing said vertical portion to move toward and away from said access opening and for allowing said horizontal portion to be slidably received into said main body and for, when said vertical portion is moved to its closest position toward said access opening, closing said access opening;

a choke structure positioned around the periphery of said vertical portion for preventing leakage of high frequency energy around the periphery of said vertical portion;

adjusting means operatively associated with said horizontal and vertical portions for adjusting the angle between said horizontal and vertical portions;

a cantilever shelf member having one end thereof mounted on said vertical portion and being slidably received within said heating chamber, said shelf member being supported only at said one end when said vertical portion is in its furthermost position away from said opening and an opposite end of said shelf member being supported by said bottom wall when said vertical portion is moved toward said opening;

a turntable rotatably mounted on said shelf member;

a magnetic coupling means operatively associated with said turntable for rotating said turntable; and a driving means operatively associated with said magnetic coupling means for driving said coupling means and thereby rotating said turntable.

6. A high frequency heating apparatus as claimed in claim 5, further comprising:

a first safety switch means positioned at the upper part of said vertical portion operatively associated with said door for deactivating said high frequency energy oscillating means when said opening is not closed by said vertical portion; and a second safety switch means positioned within said main body and adjacent said horizontal portion for deactivating said high frequency energy oscillating means when said opening is not closed by said vertical portion.

7. A high frequency heating apparatus comprising:

a main body having a heating chamber therein;

said heating chamber having an access opening in one side thereof and a bottom wall;

a high frequency energy oscillating means for supplying high frequency energy into said heating chamber;

a drawer type door having a substantially horizontal and vertical portion defining an L shaped cross section in a vertical plane parallel to a longitudinal axis of said door, said horizontal portion being longitudinally slidably received into said main body for allowing said vertical portion to close said access opening;

a cantilever shelf member having one end thereof mounted on said vertical portion and being slidably received within said heating chamber, said shelf member being supported only at said one end when said door is in its furthermost position away from said opening and an opposite end of said shelf member being supported by said bottom wall when said door is moved toward said opening;

a turntable rotatably mounted on said shelf member;

a magnetic coupling means operatively associated with said turntable for rotating said turntable;

a driving means operatively associated with said magnetic coupling means for driving said coupling means and thereby rotating said turntable;

a shank member connected to said horizontal portion;

a safety switch means positioned within said main body and adjacent said horizontal portion and slidably receiving said shank member for allowing said high frequency oscillating means to be activated when said shank member is slidably received therein; and a restricting means operatively associated with said safety switch means for restricting the activating of said high frequency oscillating means when said shank member is deformed from its normal shape.

8. A high frequency heating apparatus as claimed in claim 7, further comprising:

a stationary rail member fixedly positioned within said main body and extending along a longitudinal axis thereof;

a movable rail member attached to said door and extending along a longitudinal axis thereof, said movable rail being slidably received by said stationary rail in the longitudinal direction for allowing said vertical portion to move toward and away from said access openings; and said stationary rail member having projecting means extending therefrom in a lateral direction toward said movable rail member for preventing substantial lateral movement of said door by abutting said movable rail member.

9. A high frequency heating apparatus as claimed in claim 7, wherein:

said main body has an inner and outer casing, said inner casing is slidably fitted into said outer casing;

said heating chamber is located within said inner casing;

said outer casing has a second stationary rail member attached to an inner wall portion;

said inner casing has a plate member on an outside portion thereof; and said plate member being structured and dimensioned to slidably engage said second stationary member when said inner casing is slidably fitted into said outer casing.

* * * * *